US006021794A

United States Patent [19]

Guerra

[11] Patent Number: 6,021,794

[45] Date of Patent: Feb. 8, 2000

[54] PORTABLE COLLAPSIBLE SHELTER

[76] Inventor: Jose Inez Guerra, 11130 9 3/4 Ave., Hanford, Calif. 93230

[21] Appl. No.: 09/234,694

[22] Filed: Jan. 21, 1999

[51] Int. Cl.[7] ..... E04H 15/30; E04H 15/34

[52] U.S. Cl. ..... 135/95; 135/87; 135/90; 135/96; 135/121; 135/904; 135/901; 224/153; 224/154; 224/155; 224/156

[58] Field of Search ..... 52/2.22, 2.23; 135/90, 95, 96, 121, 127, 904; 224/153, 154, 155, 156

[56] References Cited

U.S. PATENT DOCUMENTS

| | | | |
|---|---|---|---|
| 3,757,360 | 9/1973 | Wescott | 5/113 |
| 3,933,164 | 1/1976 | Ness et al. | 135/1 R |
| 4,077,418 | 3/1978 | Cohen | 135/4 R |
| 4,186,507 | 2/1980 | Stinnett | 43/1 |
| 4,234,005 | 11/1980 | Taylor, III | 135/1 R |
| 4,438,876 | 3/1984 | Ward | 224/154 |
| 4,636,478 | 1/1987 | Chen | 52/2.11 |
| 4,883,206 | 11/1989 | Miller | 224/153 |
| 4,885,812 | 12/1989 | Linder | 5/113 |
| 4,926,893 | 5/1990 | Klopfenstein et al. | 135/106 |
| 5,813,160 | 9/1998 | Thoelke | 43/1 |

FOREIGN PATENT DOCUMENTS

| | | | |
|---|---|---|---|
| 2454775 | 12/1980 | France | 135/904 |
| 14806 | 10/1926 | Netherlands | 135/904 |

*Primary Examiner*—Carl D. Friedman
*Assistant Examiner*—Jennifer I. Thissell

[57] ABSTRACT

A portable shelter is provided including a frame having a base and a collapsible upper portion. A cover is removably mounted on the upper portion of the frame. A pair of shoulder straps are each coupled to the base of the frame for allowing the same to be worn on a back of a user. Next provided is a bag mounted on the base for receiving the cover.

14 Claims, 3 Drawing Sheets

Fig. 1
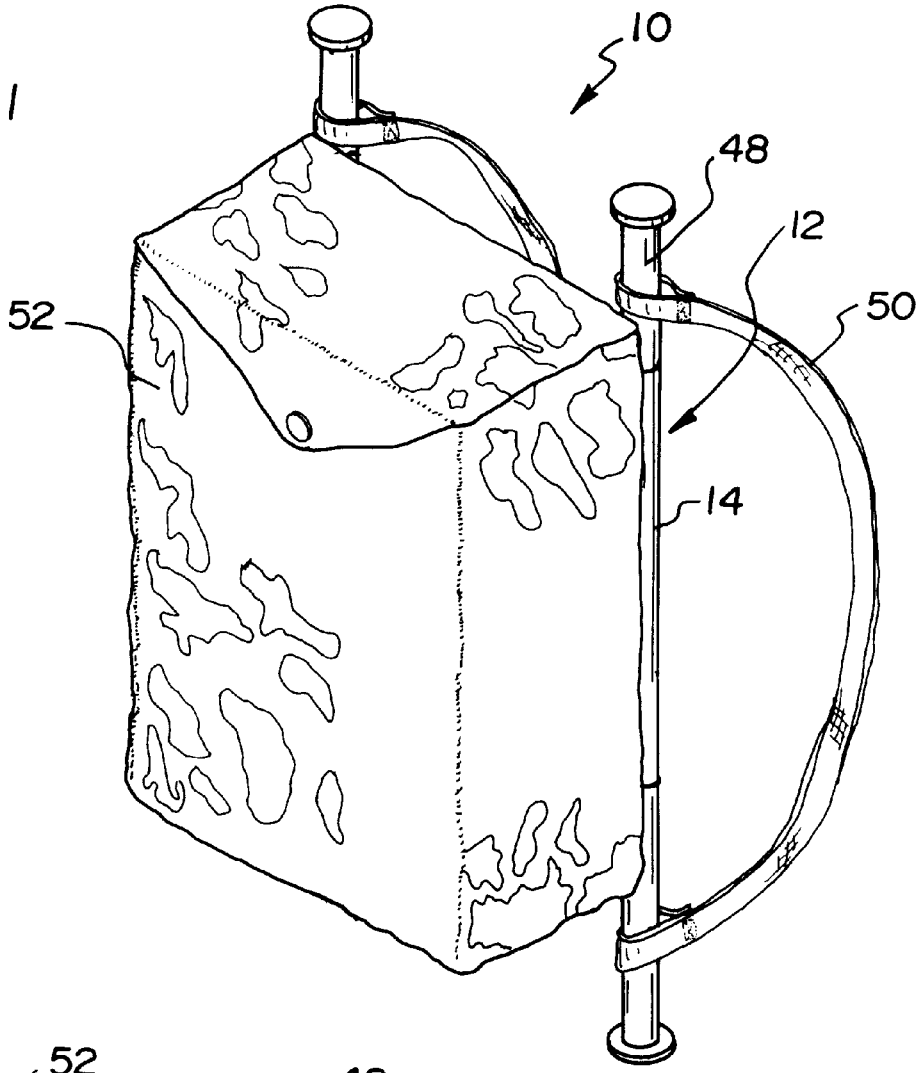
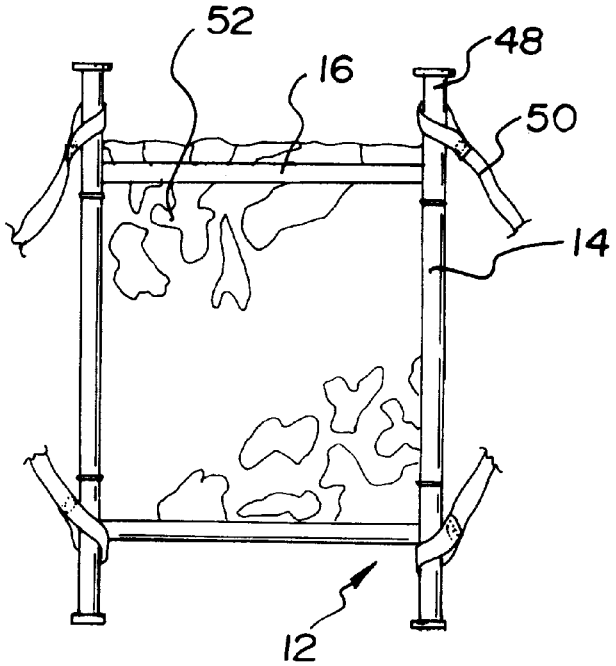
Fig. 2

PORTABLE COLLAPSIBLE SHELTER

BACKGROUND OF THE INVENTION

1. Field of the Invention

The present invention relates to tents and more particularly pertains to a new portable collapsible shelter for fishing, hunting and sleeping within a unit which is easily transported and assembled.

2. Description of the Prior Art

The use of tents is known in the prior art. More specifically, tents heretofore devised and utilized are known to consist basically of familiar, expected and obvious structural configurations, notwithstanding the myriad of designs encompassed by the crowded prior art which have been developed for the fulfillment of Countless objectives and requirements.

Known prior art tents include U.S. Pat. No. 4,883,206; U.S. Pat. No. 5,277,349; U.S. Pat. No. 4,418,854; U.S. Pat. No. 4,241,745; U.S. Pat. No. 4,251,015, and U.S. Pat. No. Des. 270,928.

In these respects, the portable collapsible shelter according to the present invention substantially departs from the conventional concepts and designs of the prior art, and in so doing provides an apparatus primarily developed for the purpose of fishing, hunting and sleeping within a unit which is easily transported and assembled.

SUMMARY OF THE INVENTION

In view of the foregoing disadvantages inherent in the known types of tents now present in the prior art, the present invention provides a new portable collapsible shelter construction wherein the same can be utilized for fishing, hunting and sleeping within a unit which is easily transported and assembled.

The general purpose of the present invention, which will be described subsequently in greater detail, is to provide a new portable collapsible shelter apparatus and method which has many of the advantages of the tents mentioned heretofore and many novel features that result in a new portable collapsible shelter which is not anticipated, rendered obvious, suggested, or even implied by any of the prior art tents, either alone or in any combination thereof.

To attain this, the present invention generally comprises a frame having a base with a pair of hollow elongated rods and a pair of short rods coupled between the elongated rods. Such coupling is effected adjacent to and spaced from ends of the elongated rods for reasons that will soon become apparent. The frame further includes a plurality of stanchions releasably connected to the base and extending upwardly therefrom. Associated therewith is a plurality of interconnect rods coupled between the stanchions at a central extent thereof and at a top end thereof. As such, an intermediate square support and an upper square support are defined, respectively. As shown in FIG. 3, the upper square support includes a diagonal interconnect rod. Next provided is a camouflage canvas including a top wall and four side walls for being removably slid over the stanchions and interconnect rods of the frame. As shown in FIG. 3, a first one of the side walls includes a square cut out. Such square cut out is formed in the first side wall between the intermediate square support and the upper square support of the frame. For passing a gun or fishing pole, a plurality of vertically aligned apertures are formed in the first side wall adjacent to side edges of the square cut out. Further, a flap is integrally coupled to a top edge of the square cut out.

Second and third opposed side walls of the canvas each have an upper rectangular cut out including a flap integrally coupled to a top edge thereof. The second and third opposed side walls further have a lower rectangular cut out situated below the upper rectangular cut out and above the intermediate square support of the frame. A mesh material covers such lower rectangular cut outs. For passing a gun or fishing pole, a vertically oriented bisecting slit is formed in the mesh material. The lower rectangular cut outs of the second and third side walls of the canvas are each also equipped with a flap integrally coupled to a top edge of the lower rectangular cut out. Either the second or third side walls of the canvas has a plurality of snap fasteners mounted about a periphery of an interior surface thereof for reasons that will become apparent hereinafter. Each of the flaps has a first orientation for covering to associated cut out. When in the first orientation, the flaps are held in place by way of snap fasteners mounted along a bottom edge of the flap. These snap fasteners couple with snap fasteners lining a bottom edge of the associated cut out. Each flap is also capable of a second orientation rolled up and tied in place by way of a pair of ties coupled to the top edge of the associated cut out. FIG. 6 shows an inflatable bed with a rectangular configuration. The inflatable bed is formed of a lower face, an upper face and a periphery formed therebetween. Such periphery is equipped with a size and shape similar to that of one of side walls. The lower face has a peripheral lip integrally coupled thereto and extending therefrom in coplanar relationship therewith. This peripheral lip has a plurality of snap fasteners for coupling with those of the side wall of the canvas. After use, the stanchions and the interconnect rods of the frame are collapsible such that the same may be stored within the hollow elongated rods of the frame. Such components are maintained within the hollow elongated rods with caps removably mounted on ends of the elongated rods. The caps are each equipped with a radially extending flange formed on its end. FIGS. 1 & 2 show a pair of flexible shoulder straps each with a closed loop formed on each end. The straps serve for being received by one of the end caps such that the base of the frame may be worn on a back of a user. Lastly, a canvas bag has a face coupled to the base of the frame and an opening with a lid for allowing selective access thereto. After use, the canvas, stanchions, interconnect rods, and inflatable bed may be stored within the bag such that present invention may be transported on the back of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable collapsible shelter apparatus and method which has many of the advantages of the tents mentioned heretofore and many novel features that result in a new portable collapsible shelter which is not anticipated, rendered obvious, suggested, or even implied by any of the prior art tents, either alone or in any combination thereof.

It is another object of the present invention to provide a new portable collapsible shelter which may be easily and efficiently manufactured and marketed.

It is a further object of the present invention to provide a new portable collapsible shelter which is of a durable and reliable construction.

An even further object of the present invention is to provide a new portable collapsible shelter which is susceptible of a low cost of manufacture with regard to both materials and labor, and which accordingly is then susceptible of low prices of sale to the consuming public, thereby making such portable collapsible shelter economically available to the buying public.

Still yet another object of the present invention is to provide a new portable collapsible shelter which provides in the apparatuses and methods of the prior art some of the advantages thereof, while simultaneously overcoming some of the disadvantages normally associated therewith.

Still another object of the present invention is to provide a new portable collapsible shelter for fishing, hunting and sleeping within a unit which is easily transported and assembled.

Even still another object of the present invention is to provide a new portable collapsible shelter that includes a frame having a base and a collapsible upper portion. A cover is removably mounted on the upper portion of the frame. A pair of shoulder straps are each coupled to the base of the frame for allowing the same to be worn on a back of a user. Next provided is a bag mounted on the base for receiving the cover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front perspective view of the present invention in a stored orientation.

FIG. 2 is a rear perspective view of the present invention in the stored orientation.

DESCRIPTION OF THE PREFERRED EMBODIMENT

Figure 3:
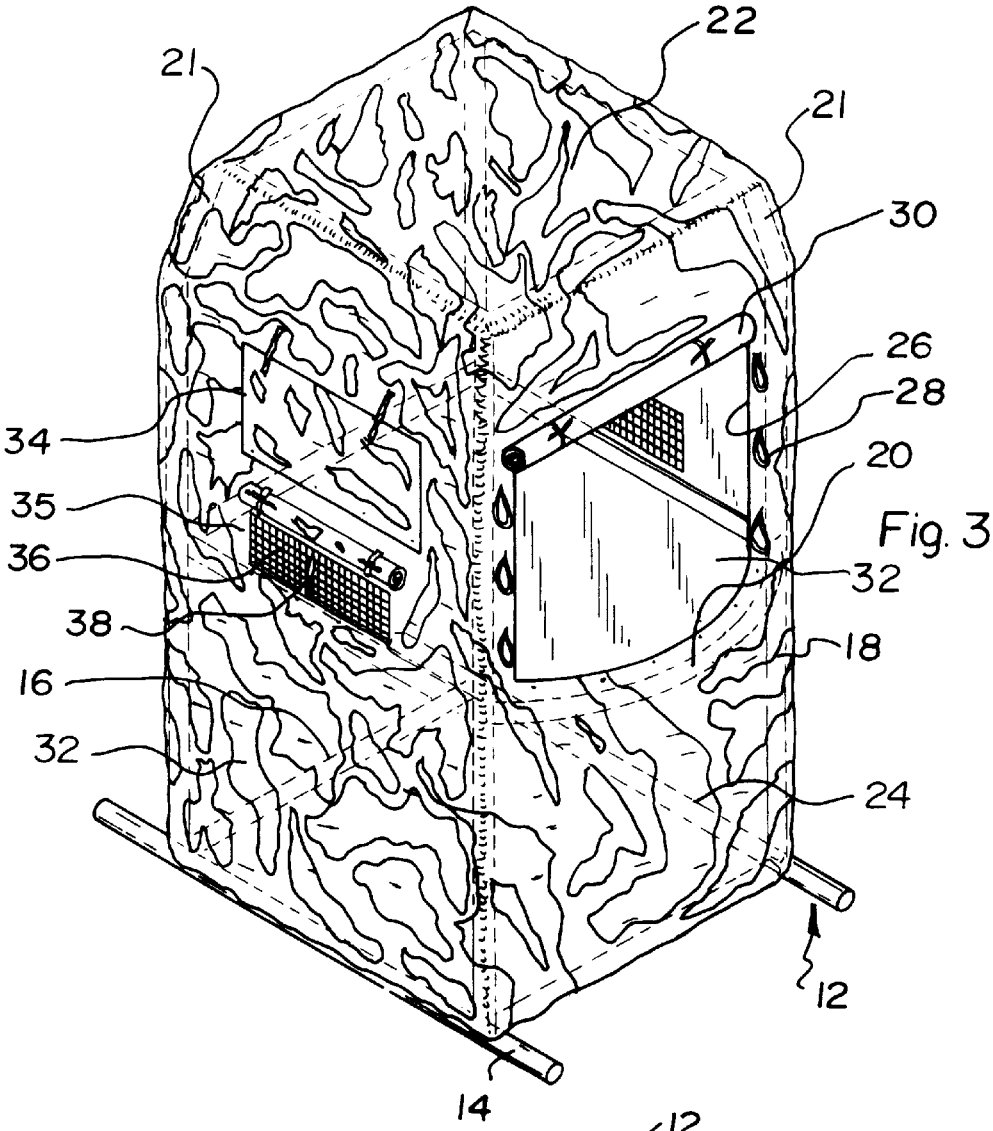
FIG. 3 is a perspective view of the present invention in an erected deployed orientation for hunting and fishing.
Figure 4:
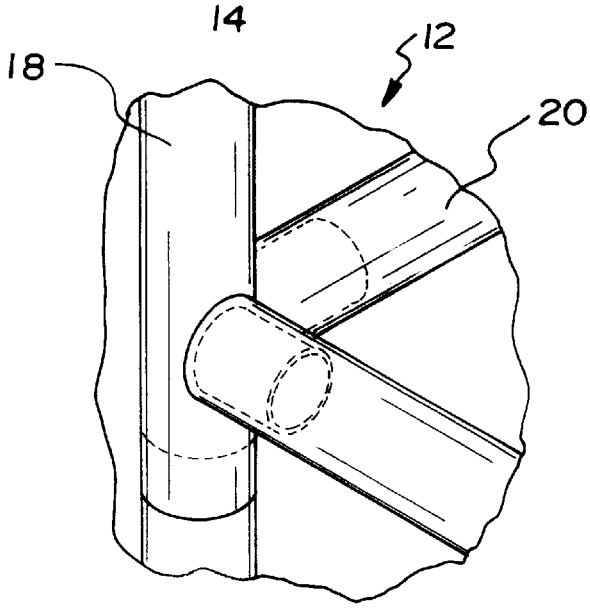
FIG. 4 is a close-up view of the interconnection between the interconnect rods and the stanchions of the present invention.

With reference now to the drawings, and in particular to FIGS. 1 through 6 thereof, a new portable collapsible shelter embodying the principles and concepts of the present invention and generally designated by the reference numeral 10 will be described.

The present invention, designated as numeral 10, includes a frame 12 having a base with a pair of hollow elongated rods 14 and a pair of short rods 16 fixedly coupled between the elongated rods. Such coupling is effected adjacent to and spaced from ends of the elongated rods for reasons that will soon become apparent. Note FIG. 2.

The frame further includes a plurality of stanchions 18 connected to the base and extending upwardly therefrom. Associated therewith is a plurality of interconnect rods 20 coupled between the stanchions at a central extent thereof and at a top end thereof. As such, an intermediate square support and an upper square support are defined, respectively. As shown in FIG. 3, the upper square support includes a diagonal interconnect rod 21. It should be noted that the base, stanchions, and interconnect rods may be collapsibly assembled by way of hinges removable male and female joints, or the like.

Next provided is a camouflage canvas 22 including a top wall and four side walls for being removably slid over the stanchions and interconnect rods of the frame. The side walls are preferably twice the size of the top wall. As shown in FIG. 3, a first one of the side walls 24 includes a square cut out 26. Such square cut out is formed in the first side wall between the intermediate square support and the upper square support of the frame. For passing a gun or fishing pole, a plurality of vertically aligned apertures 28 are formed in the first side wall adjacent to side edges of the square cut out. Further, a flap 30 is integrally coupled to a top edge of the square cut out.

Second and third opposed side walls 32 of the canvas each have an upper rectangular cut out 34 including a flap integrally coupled to a top edge thereof. The second and third opposed side walls further have a lower rectangular cut out situated below the upper rectangular cut out and above the intermediate square support of the frame. A mesh material 36 covers such lower rectangular cut outs. For passing a gun or fishing pole, a vertically oriented bisecting slit 38 is formed in the mesh material. The lower rectangular cut outs of the second and third side walls of the canvas are each also equipped with a flap integrally coupled to a top edge of the lower rectangular cut out. Either the second or third side walls of the canvas has a plurality of snap fasteners 40 mounted about a periphery of an interior surface thereof for reasons that will become apparent hereinafter.

Each of the flaps has a first orientation for covering the associated cut out. When in the first orientation the flaps are held in place by way of snap fasteners mounted along a bottom edge of the flap. These snap fasteners couple with snap fasteners lining a bottom edge of the associated cut out. Each flap is also capable of a second orientation rolled up and tied in place by way of a pair of ties coupled to the top edge of the associated cut out.

Figure 6:
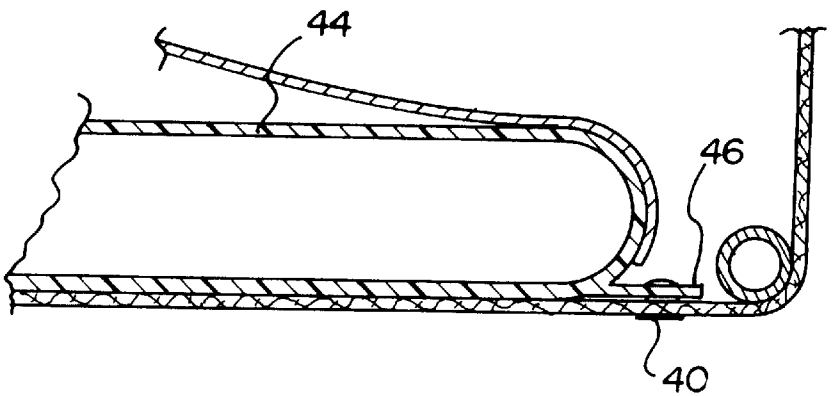
FIG. 6 is a side cross-sectional view of the bed of the present invention taken along line 6—6 shown in FIG. 5.

FIG. 6 shows an inflatable bed 44 with a rectangular configuration. The inflatable bed is formed of a lower face an upper face and a periphery formed therebetween. Such periphery is equipped with a size and shape similar to that of one of side walls of the canvas. The lower face has a peripheral lip 46 integrally coupled thereto which extends there from in coplanar relationship therewith. This peripheral lip has a plurality of snap fasteners for coupling with those of the side wall of the canvas.

Figure 5:
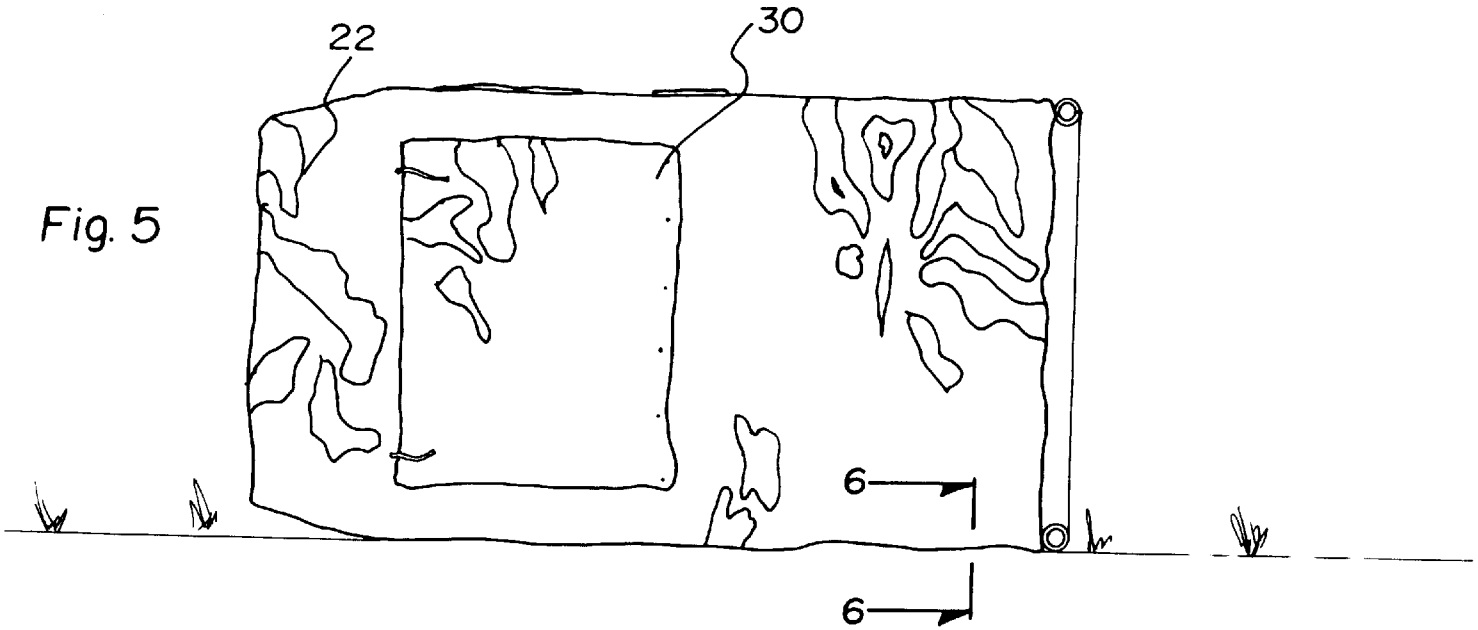
FIG. 5 is a perspective view of the present invention in a prone deployed orientation for sleeping.

In use, the frame and canvas has an erected orientation for allowing a user to hunt and fish from within. Note FIG. 3. When in such orientation, weights such as rocks may be placed on the elongated rods to maintain the frame erect. As shown in FIG. 5, the frame and canvas may be laid in a prone orientation with the bed snappily coupled to the canvas. In such orientation, a user may use the present invention as a protective tent. Ideally, the frame has dimensions of 4×4×6 feet when in use.

After use, the stanchions and the interconnect rods of the frame are collapsible such that the same may be stored within the hollow elongated rods of the frame. Such components are maintained within the hollow elongated rods with caps 48 removably mounted on ends of the elongated rods. The caps are each equipped with a radially extending flange formed on its end.

FIGS. 1 & 2 show a pair of flexible shoulder straps 50 each with a closed loop formed on each end. The straps serve for being received by one of the end caps such that the base of the frame may be worn on a back of a user.

Lastly, a canvas bag 52 has a face coupled to the base of the frame and an opening with a lid for allowing selective access thereto. During use, the bag serves as a bottom of the canvas. After use, the canvas, stanchions, interconnect rods, and inflatable bed may be stored within the bag such that present invention may be transported on the back of the user. It should be noted that either the elongated rods or the canvas bag may be used to store the collapsible upper portion of the frame depending on the means by which the frame is made collapsible and the desires of the user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable hunting, fishing, and sleeping shelter comprising, in combination:

a frame including a base having a pair of hollow elongated rods and a pair of short rods coupled between the elongated rods adjacent to and spaced from ends of the elongated rods, the frame further including a plurality of stanchions releasably connected to the base and extending upwardly therefrom and a plurality of interconnect rods coupled between the stanchions at a central extent thereof and at a top end thereof to define an intermediate square support and an upper square support, respectively, wherein the upper square support includes a diagonal interconnect rod;

a camouflage canvas including a top wall and four side walls for being removably slid over the stanchions and interconnect rods of the frame, a first one of the side walls including a square cut out formed therein between the intermediate square support and the upper square support of the frame with a plurality of vertically aligned apertures formed in the first side wall adjacent to side edges of the square cut out and a flap integrally coupled to a top edge of the square cut out, second and third opposed side walls of the canvas each having an upper rectangular cut out including a flap integrally coupled to a top edge of the upper rectangular cut out and a lower rectangular cut out situated below the upper rectangular cut out and above the intermediate square support of the frame with a mesh material covering the same which has a vertically oriented bisecting slit formed therein, the lower rectangular cut out of the second and third side walls of the canvas further including a flap integrally coupled to a top edge of the lower rectangular cut out, one of the side walls of the canvas having a plurality of snap fasteners mounted about a periphery of an interior surface thereof, wherein each of the flaps has a first orientation for covering the associated cut out and held in place by way of snap fasteners mounted along a bottom edge of the flap which couple with snap fasteners lining a bottom edge of the associated cut out and a second orientation rolled up and tied in place by way of a pair of ties coupled to the top edge of the associated cut out;

an inflatable bed with a rectangular configuration formed of a lower face, an upper face and a periphery formed therebetween with a size and shape similar to that of one of side walls, the lower face having a peripheral lip integrally coupled thereto and extending therefrom in coplanar relationship therewith, the peripheral lip having a plurality of snap fasteners for coupling with those of one of the side walls of the canvas;

wherein the stanchions and the interconnect rods of the frame are collapsible such that the same may be stored within the hollow elongated rods of the frame and maintained therein with caps removably mounted on ends of the elongated rods each with a radially extending flange formed on an end thereof;

a pair of flexible shoulder straps each with a closed loop formed on each end thereof for being received by one of the end caps such that the base of the frame may be worn on a back of a user; and a canvas bag having a face coupled to the base of the frame and an opening with a lid for allowing selective access thereto, wherein the canvas, stanchions, interconnect rods, and inflatable bed are stored within the bag when the base of the frame is worn on the back of the user.

2. A portable shelter comprising:

a frame including a base and a collapsible upper portion;

a cover including side walls removably mounted on the upper portion of the frame, one of the side walls of the cover having a plurality of apertures formed therein for allowing the passage of at least one of a gun and a fishing rod;

a pair of shoulder straps each coupled to the base of the frame for allowing the same to be worn on a back of a user; and a bag mounted on the base for receiving the cover.

3. A portable shelter as set forth in claim 2 wherein one of the side walls of the cover has an opening with a mesh material mounted thereover, the mesh material having a slit formed therein for allowing the passage of at least one of a gun and a fishing rod.

4. A portable shelter as set forth in claim 2 and further including a bed removably mounted on a side wall of the cover for supporting the user when the frame is laid sideways.

5. A portable shelter as set forth in claim 4 wherein the bed is inflatable.

6. A portable shelter as set forth in claim 2 wherein the base has a pair of short interconnect rods extending between a pair of elongated rods, the short interconnect rods and the elongated rods are for having weight supported thereon to maintain the frame upright.

7. A portable shelter comprising:

a frame including a base and a collapsible upper portion;

a cover including side walls removably mounted on the upper portion of the frame, one of the side walls of the cover having an opening with a mesh material mounted thereover, the mesh material having a slit formed therein for allowing the passage of at least one of a gun and a fishing rod;

a pair of shoulder straps each coupled to the base of the frame for allowing the same to be worn on a back of a user; and a bag mounted on the base for receiving the cover.

8. A portable shelter as set forth in claim 7 and further including a bed removably mounted on a side wall of the cover for supporting the user when the frame is laid sideways.

9. A portable shelter as set forth in claim 8 wherein the bed is inflatable.

10. A portable shelter as set forth in claim 7 wherein the base has a pair of short interconnect rods extending between a pair of elongated rods, the short interconnect rods and the elongated rods are for having weight supported thereon to maintain the frame upright.

11. A portable shelter comprising:

a frame including a base and a collapsible upper portion;

a cover including side walls removably mounted on the upper portion of the frame;

a bed removably mounted one of the side walls of the cover for supporting the user when the frame being laid sideways;

a pair of shoulder straps each coupled to the base of the frame for allowing the same to be worn on a back of a user; and a bag mounted on the base for receiving the cover.

12. A portable shelter as set forth in claim 11 wherein the bed is inflatable.

13. A portable shelter as set forth in claim 11 wherein the base has a pair of short interconnect rods extending between a pair of elongated rods, the short interconnect rods and the elongated rods are for having weight supported thereon to maintain the frame upright.

14. A portable shelter comprising:

a frame including a base and a collapsible upper portion, the base has a pair of short interconnect rods extending between a pair of elongated rods, the short interconnect rods and the elongated rods are for having weight supported thereon to maintain the frame upright;

a cover including side walls removably mounted on the upper portion of the frame;

a pair of shoulder straps each coupled to the base of the frame for allowing the same to be worn on a back of a user; and a bag mounted on the base for receiving the cover.

* * * * *